US010082320B2

(12) United States Patent
Korenaga

(10) Patent No.: US 10,082,320 B2
(45) Date of Patent: Sep. 25, 2018

(54) AIR-CONDITIONING APPARATUS

(71) Applicant: Mitsubishi Electric Corporation, Tokyo (JP)

(72) Inventor: Kazunori Korenaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 201 days.

(21) Appl. No.: 14/872,195

(22) Filed: Oct. 1, 2015

(65) Prior Publication Data

US 2016/0097568 A1 Apr. 7, 2016

(30) Foreign Application Priority Data

Oct. 3, 2014 (JP) ..... 2014-204485

(51) Int. Cl.
*F25B 41/04* (2006.01)
*F25B 13/00* (2006.01)
*F25B 49/02* (2006.01)

(52) U.S. Cl.
CPC ..... *F25B 13/00* (2013.01); *F25B 49/02* (2013.01); *F25B 2313/006* (2013.01); *F25B 2313/0314* (2013.01); *F25B 2400/13* (2013.01); *F25B 2600/2509* (2013.01); *F25B 2600/2513* (2013.01); *F25B 2700/1931* (2013.01); *F25B 2700/1933* (2013.01); *F25B 2700/2115* (2013.01)

(58) Field of Classification Search
CPC .. F25B 13/00; F25B 49/02; F25B 2700/2115; F25B 2700/1933
See application file for complete search history.

(56) References Cited

FOREIGN PATENT DOCUMENTS

JP 2004-183913 A 7/2004
JP 2004183913 A * 7/2004
JP 2004257686 A * 9/2004
(Continued)

OTHER PUBLICATIONS

Kazemura et al., Refrigerant Relay Unit for Air Conditioner, Sep. 16, 2004, JP2004257686A, Whole Document.*
(Continued)

*Primary Examiner* — Larry Furdge
(74) *Attorney, Agent, or Firm* — Posz Law Group, PLC

(57) ABSTRACT

An air-conditioning apparatus includes: a refrigeration cycle; an injection circuit for connecting between an injection port and a branching portion arranged between an indoor expansion valve and a main circuit expansion valve; an injection circuit expansion valve arranged in the injection circuit; an internal heat exchanger for exchanging heat between refrigerant flowing between the branching portion and the main circuit expansion valve and refrigerant depressurized by the injection circuit expansion valve; and an outdoor unit control device, the outdoor unit control device being configured to control an opening degree A of the main circuit expansion valve so as to satisfy Relation A+C=B×Gr, where A represents the opening degree of the main circuit expansion valve, C represents an opening degree of the injection circuit expansion valve, B represents a coefficient, and Gr represents a refrigerant circulating amount in the refrigeration cycle.

18 Claims, 7 Drawing Sheets

(56) References Cited

FOREIGN PATENT DOCUMENTS

| | | | | |
|---|---|---|---|---|
| JP | 2008-241069 | A | | 10/2008 |
| JP | 2010060179 | A | * | 3/2010 |

OTHER PUBLICATIONS

Kondo, Control Device, Air Conditioner and Refrigerating Device, Mar. 18, 2010, JP2010060179A, Whole Document.*
Saito et al., Air Conditioner, Jul. 2, 2004, JP2004183913A, Whole Document.*
Extended European Search Report dated Feb. 19, 2016 in the corresponding EP application No. 15187842.8.
Office Action dated Mar. 21, 2017 in the corresponding Japanese patent application No. 2014-204485 (and English translation).
Office Action dated Nov. 27, 2017 in the corresponding CN patent application No. 201510615806.6 (and English translation).

* cited by examiner

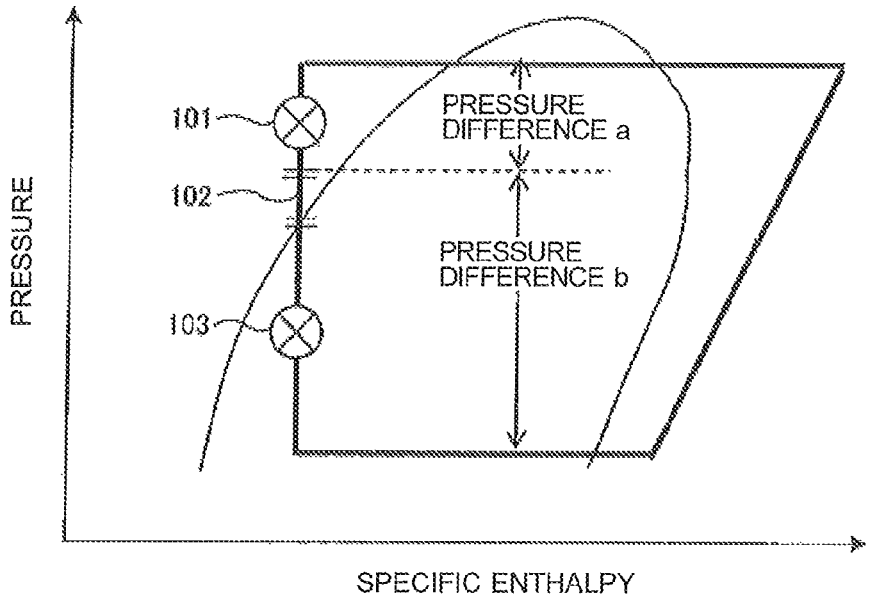
F I G. 1 0
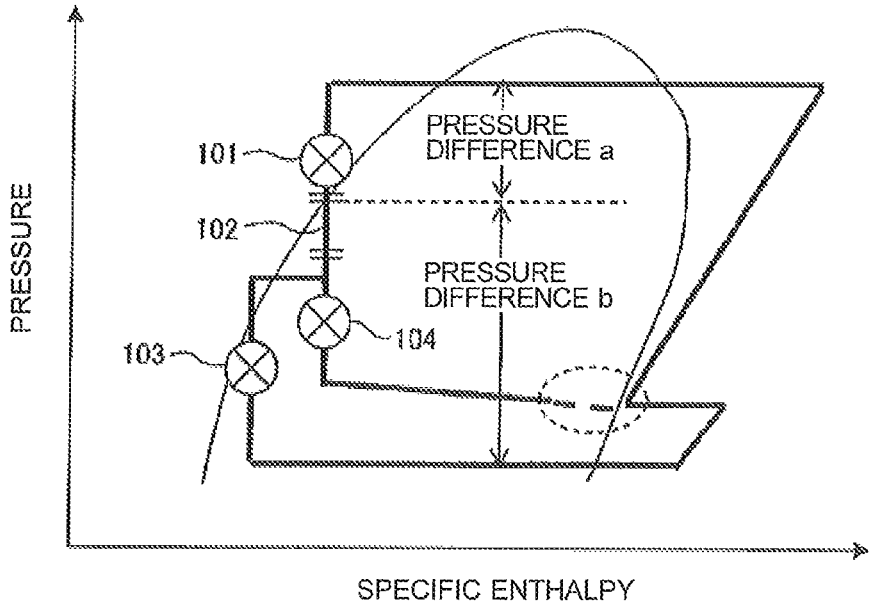

AIR-CONDITIONING APPARATUS

TECHNICAL FIELD

The present invention relates to an air-conditioning apparatus.

BACKGROUND ART

A typical air-conditioning apparatus has a refrigerant circuit configuration in which a compressor, a four-way valve, an outdoor heat exchanger, an electronic expansion valve, and an indoor heat exchanger are connected. The compressor, the four-way valve, and the outdoor heat exchanger are accommodated in an outdoor unit together with an outdoor unit-side fan for sending air to the outdoor heat exchanger. The electronic expansion valve and the indoor heat exchanger are accommodated in an indoor unit together with an indoor unit-side fan for sending air to the indoor heat exchanger. The outdoor unit and the indoor unit are connected to each other with a plurality of extension pipes.

Further, the outdoor unit includes a high-pressure sensor for detecting a discharge pressure of the compressor, a low-pressure sensor for detecting a suction pressure of the compressor, and a discharge temperature sensor for detecting a discharge temperature of the compressor. The indoor unit includes an indoor heat exchanger outlet temperature sensor for detecting a temperature of refrigerant that has passed through the indoor heat exchanger during heating operation. A controller controls the compressor, the four-way valve, the electronic expansion valve, the outdoor-side fan, and the indoor-side fan based on information acquired from the above-mentioned sensors, for example.

In the above-mentioned refrigerant circuit, during the heating operation, there is formed a flow passage for causing the high-pressure refrigerant discharged from the compressor to flow into the indoor heat exchanger. With this, during the heating operation, the indoor heat exchanger serves as a condenser, and the outdoor heat exchanger serves as an evaporator.

Patent Literature 1 discloses an air-conditioning apparatus configured to form a refrigeration cycle by sequentially connecting a low stage-side compressor capable of adjusting a rotation speed, a high stage-side compressor capable of adjusting a rotation speed independently of the low stage-side compressor, a condenser, a first pressure reducing device, and an evaporator. Between the condenser and the first pressure reducing device of this air-conditioning apparatus, an intercooler (internal heat exchanger) is arranged. Part of the refrigerant flowing out from the condenser becomes a branched flow branched from a main-stream refrigerant, and is depressurized to an intermediate pressure through a second pressure reducing device. The depressurized branched flow exchanges heat with the main-stream refrigerant at the intercooler, and then flows into the suction side of the high stage-side compressor.

Further, in Patent Literature 2, there is disclosed an air-conditioning apparatus including a refrigeration cycle in which an injection compressor, a condenser, a first pressure reducing device, and an evaporator are sequentially and annularly connected, and an injection circuit branched at a branching portion between the condenser and the first pressure reducing device, for injecting the refrigerant to the injection compressor through a second pressure reducing device. This air-conditioning apparatus includes an internal heat exchanger for exchanging heat between the refrigerant of the injection circuit, which is depressurized by the second pressure reducing device, and the refrigerant of the refrigeration cycle, which flows between the branching portion and the first pressure reducing device.

CITATION LIST

Patent Literature

Patent Literature 1: Japanese Unexamined Patent Application Publication No. 2004-183913

Patent Literature 2: Japanese Unexamined Patent Application Publication No. 2008-241069

SUMMARY OF INVENTION

Technical Problem

In a typical air-conditioning apparatus, the amount of refrigerant necessary during heating operation is smaller than the amount of refrigerant necessary during cooling operation. Particularly when the length of the extension pipe is large, the difference between the amount of refrigerant necessary during cooling operation and the amount of refrigerant necessary during heating operation is increased. As a refrigerant circuit configuration capable of absorbing this difference in necessary refrigerant amount, there is known a configuration in which, in addition to an expansion valve (indoor expansion valve) of the indoor unit, an expansion valve (main circuit expansion valve) is also arranged in the outdoor unit. Similarly to the internal heat exchanger of the air-conditioning apparatus disclosed in Patent Literatures 1 and 2, the main circuit expansion valve is arranged between the indoor expansion valve and the outdoor heat exchanger. During the heating operation, an opening degree of the main circuit expansion valve is appropriately reduced, to thereby accumulate the liquid-phase refrigerant in the extension pipe. With this, the difference in necessary refrigerant amount can be absorbed.

FIG. 9 is a Mollier chart illustrating an example of an operation state during the heating operation in the air-conditioning apparatus including the indoor expansion valve and the main circuit expansion valve. An opening degree of a main circuit expansion valve 103 is controlled so that a decompression amount (pressure difference "a") at an indoor expansion valve 101 serving as an upstream-side expansion valve during the heating operation and a decompression amount (pressure difference "b") at the main circuit expansion valve 103 serving as a downstream-side expansion valve are maintained to a predetermined ratio x:y. The ratio x:y can be arbitrarily set. Through setting of the pressure difference "a" small and the pressure difference "b" large as illustrated in FIG. 9, the refrigerant inside a liquid-side extension pipe 102 connecting the indoor unit and the outdoor unit to each other approaches a liquid phase, which makes it easier to absorb the difference between the amount of refrigerant necessary during cooling operation and the amount of refrigerant necessary during heating operation. For example, the opening degree of the main circuit expansion valve 103 is controlled based on a discharge pressure and a suction pressure of the compressor and a refrigerant circulating amount.

FIG. 10 is a Mollier chart illustrating an example of an operation state during the heating operation in the air-conditioning apparatus further including, in addition to the indoor expansion valve and the main circuit expansion valve, the injection circuit as disclosed in Patent Literature 1 or 2. In this case, an injection circuit expansion valve 104 in the injection circuit is controlled so that the discharge superheat of the compressor converges to a constant value.

When the injection circuit expansion valve 104 is in an open state, the downstream-side pressure difference "b" depends on not the opening degree of only the main circuit expansion valve 103 but the opening degrees of both of the main circuit expansion valve 103 and the injection circuit expansion valve 104. Therefore, unlike the case illustrated in FIG. 9, it becomes difficult to maintain the predetermined ratio x:y through the control of the opening degree of the main circuit expansion valve 103. Specifically, as illustrated in FIG. 10, the pressure difference "a" tends to increase, and the pressure difference "b" tends to decrease. In this case, the rate occupied by the two-phase refrigerant is increased in the liquid-side extension pipe 102, and hence the amount of refrigerant to be accumulated in the liquid-side extension pipe 102 during the heating operation is decreased. Therefore, there has been a problem in that it becomes difficult to absorb the difference between the amount of refrigerant necessary during cooling operation and the amount of refrigerant necessary during heating operation.

In the above-mentioned air-conditioning apparatus, in order to maintain the predetermined ratio x:y, it is conceivable to add an intermediate-pressure sensor for detecting the pressure (intermediate pressure) of the refrigerant that has passed through the indoor expansion valve 101. Specifically, it is conceivable to feedback control the opening degree of the main circuit expansion valve 103 based on the pressure difference "a" between the discharge pressure and the intermediate pressure and the pressure difference "b" between the intermediate pressure and the suction pressure so that the pressure difference "a" and the pressure difference "b" maintain the ratio x:y. However, in this case, it is necessary to add the intermediate-pressure sensor, and hence there has been a problem in that the manufacturing cost of the air-conditioning apparatus is increased.

The present invention has been made to solve at least one of the problems described above, and has an object to provide an air-conditioning apparatus capable of accumulating a larger amount of refrigerant in a refrigerant pipe during the heating operation while keeping the manufacturing cost low.

Solution to Problem

According to one embodiment of the present invention, there is provided an air-conditioning apparatus, including: a refrigeration cycle connecting, by refrigerant pipes, a compressor having an injection port, an indoor heat exchanger, a first pressure reducing device, a second pressure reducing device, and an outdoor heat exchanger; an injection circuit connecting between the injection port and a branching portion arranged between the first pressure reducing device and the second pressure reducing device of the refrigeration cycle; a third pressure reducing device arranged in the injection circuit; an internal heat exchanger configured to exchange heat between refrigerant flowing between the branching portion and the second pressure reducing device and refrigerant depressurized by the third pressure reducing device; and a controller configured to control at least an opening degree of the second pressure reducing device, the refrigeration cycle being operable in a heating operation in which the indoor heat exchanger serves as a condenser and the outdoor heat exchanger serves as an evaporator, the controller being configured to control an opening degree A of the second pressure reducing device to satisfy Relation $A+C=B\times Gr$, where A represents the opening degree of the second pressure reducing device, C represents an opening degree of the third pressure reducing device, B represents a coefficient determined based on a discharge pressure and a suction pressure of the compressor, and Gr represents a refrigerant circulating amount in the refrigeration cycle.

Advantageous Effects of Invention

According to the one embodiment of the present invention, during the heating operation, the opening degree of the second pressure reducing device can be appropriately controlled, and hence a larger amount of refrigerant can be accumulated in the refrigerant pipe. Further, it is not necessary to add a pressure sensor for detecting the pressure of the refrigerant that has passed through the first pressure reducing device, and hence the manufacturing cost of the air-conditioning apparatus can be kept low.

BRIEF DESCRIPTION OF DRAWINGS

FIG. 9 is a Mollier chart illustrating an example of an operation state during heating operation in an air-conditioning apparatus including an indoor expansion valve and a main circuit expansion valve.

FIG. 10 is a Mollier chart illustrating an example of an operation state during heating operation in an air-conditioning apparatus further including an injection circuit.

DESCRIPTION OF EMBODIMENTS

Embodiment 1

Figure 1:
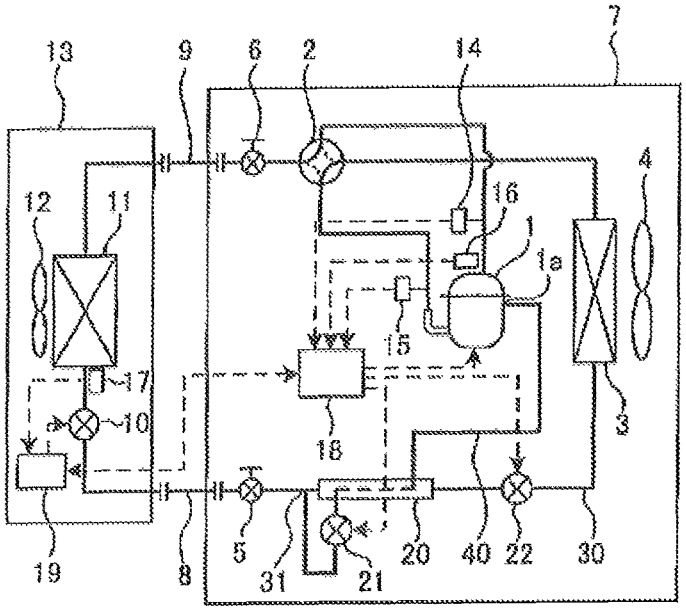
FIG. 1 is a refrigerant circuit diagram illustrating a schematic configuration of an air-conditioning apparatus according to Embodiment 1 of the present invention.

An air-conditioning apparatus according to Embodiment 1 of the present invention is described. FIG. 1 is a refrigerant circuit diagram illustrating a schematic configuration of the air-conditioning apparatus according to this embodiment. As illustrated in FIG. 1, the air-conditioning apparatus includes an outdoor unit 7 installed outdoors, for example, and an indoor unit 13 installed indoors, for example. Further, the air-conditioning apparatus includes a refrigeration cycle 30 (main circuit) for circulating the refrigerant. The refrigeration cycle 30 has a configuration in which, in a flow during heating operation, a compressor 1, a four-way valve 2, an indoor heat exchanger 11, an indoor expansion valve 10 (example of a first pressure reducing device), a main circuit expansion valve 22 (example of a second pressure reducing device), and an outdoor heat exchanger 3 are sequentially and annularly connected through refrigerant pipes.

The compressor 1 is a fluid machine for compressing a sucked low-pressure refrigerant, and discharging the compressed refrigerant as a high-pressure refrigerant. The compressor 1 of this embodiment has an injection port 1*a*. With this, the compressor 1 has a structure capable of injecting intermediate-pressure two-phase gas-liquid refrigerant into a compression chamber in the middle of a compression process through the injection port 1*a*. The intermediate pressure herein refers to a pressure lower than a high-pressure-side pressure (for example, condensation pressure) of the refrigeration cycle 30, and higher than a low-pressure-side pressure (for example, evaporation pressure). The four-way valve 2 switches the direction of the flow of the refrigerant in the refrigeration cycle 30 between heating operation and cooling operation. The heating operation refers to operation of supplying high-temperature and high-pressure refrigerant to the indoor heat exchanger 11, and the cooling operation refers to operation of supplying low-temperature and low-pressure refrigerant to the indoor heat exchanger 11.

The indoor heat exchanger 11 is a heat exchanger that serves as a condenser during the heating operation and serves as an evaporator during the cooling operation. In the indoor heat exchanger 11, heat is exchanged between the refrigerant flowing inside and air sent by an indoor fan 12 to be described later. The indoor expansion valve 10 is used to decompress and expand the liquid refrigerant condensed by the indoor heat exchanger 11 at least in the flow during the heating operation. In this embodiment, as the indoor expansion valve 10, an electronic linear expansion valve is used, which is controlled by an indoor unit control device 19 to be described later to enable continuous adjustment of the opening degree thereof.

The main circuit expansion valve 22 is used to decompress and expand the liquid refrigerant or the two-phase refrigerant that has passed through the indoor expansion valve 10 at least in the flow during the heating operation. In this embodiment, as the main circuit expansion valve 22, an electronic linear expansion valve is used, which is controlled by an outdoor unit control device 18 to be described later to enable continuous adjustment of the opening degree thereof. The outdoor heat exchanger 3 is a heat exchanger that serves as an evaporator during the heating operation and serves as a condenser during the cooling operation. In the outdoor heat exchanger 3, heat is exchanged between the refrigerant flowing inside and air (outside air) sent by an outdoor fan 4 to be described later.

The compressor 1, the four-way valve 2, the main circuit expansion valve 22, and the outdoor heat exchanger 3 of the refrigeration cycle 30 are accommodated in the outdoor unit 7. Further, the outdoor unit 7 includes the outdoor fan 4 for sending air to the outdoor heat exchanger 3. The indoor heat exchanger 11 and the indoor expansion valve 10 of the refrigeration cycle 30 are accommodated in the indoor unit 13. Further, the indoor unit 13 includes the indoor fan 12 for sending air to the indoor heat exchanger 11. The outdoor unit 7 and the indoor unit 13 are connected to each other through a plurality of extension pipes (in this embodiment, a liquid-side extension pipe 8 and a gas-side extension pipe 9), which are a part of the refrigerant pipes of the refrigeration cycle 30. In the refrigeration cycle 30 inside the outdoor unit 7, a gas-side extension pipe connecting valve 6 is arranged between the four-way valve 2 and the gas-side extension pipe 9. Further, in the refrigeration cycle 30 inside the outdoor unit 7, a liquid-side extension pipe connecting valve 5 is arranged between the main circuit expansion valve 22 and the liquid-side extension pipe 8.

Further, the air-conditioning apparatus includes an injection circuit 40 for injecting intermediate-pressure two-phase refrigerant into the compression chamber of the compressor 1 through the injection port 1*a*. The injection circuit 40 is branched from the refrigeration cycle 30 at a branching portion 31 positioned between the indoor expansion valve 10 and the main circuit expansion valve 22 (in this embodiment, between the liquid-side extension pipe connecting valve 5 and the main circuit expansion valve 22), and connects the branching portion 31 and the injection port 1*a* of the compressor 1 to each other. The injection circuit 40 includes an injection circuit expansion valve 21. In this embodiment, as the injection circuit expansion valve 21, an electronic linear expansion valve is used, which is controlled by the outdoor unit control device 18 to be described later to enable continuous adjustment of the opening degree thereof.

Further, the air-conditioning apparatus includes an internal heat exchanger 20 for exchanging heat between the refrigerant flowing between the branching portion 31 and the main circuit expansion valve 22 in the refrigeration cycle 30, and the refrigerant depressurized by the injection circuit expansion valve 21 of the injection circuit 40 (refrigerant flowing between the injection circuit expansion valve 21 and the injection port 1*a*). The internal heat exchanger 20 of this embodiment is a double-pipe heat exchanger including an inner flow passage formed inside an inner pipe and an outer flow passage formed between the inner pipe and an outer pipe. For example, through the inner flow passage, an intermediate-pressure or low-pressure refrigerant, which has been depressurized by the injection circuit expansion valve 21, flows.

The air-conditioning apparatus includes a high-pressure sensor 14 for detecting a pressure (discharge pressure) Pd [kgf/cm$^2$G (gauge pressure)] of the refrigerant on the condenser side of the refrigeration cycle 30, a low-pressure sensor 15 for detecting a pressure (suction pressure) Ps [kgf/cm$^2$G] of the refrigerant on the suction side, and a compressor shell temperature sensor 16 for detecting a temperature of the shell of the compressor 1 as a temperature (discharge temperature) Td [degree C.] of the refrigerant discharged from the compressor 1. A saturation condensing temperature Ct [degree C.] can be derived from a saturation temperature corresponding to the pressure Pd. Further, the air-conditioning apparatus includes an indoor heat exchanger outlet temperature sensor 17 in the indoor unit 13, for detecting a temperature of an outlet pipe of the indoor heat exchanger 11 as a temperature (indoor heat exchanger outlet temperature) Tcout of the refrigerant flowing out from the indoor heat exchanger 11 during the heating operation. As the temperature sensors such as the compressor shell temperature sensor 16 and the indoor heat exchanger outlet temperature sensor 17, thermistors can be used.

The air-conditioning apparatus includes the outdoor unit control device 18 (example of a controller) for controlling the outdoor unit 7, and the indoor unit control device 19 for controlling the indoor unit 13. Each of the outdoor unit control device 18 and the indoor unit control device 19 includes a microcomputer including a CPU, a ROM, a RAM, a timer, an I/O port, and the like. The outdoor unit control device 18 is programmed to control the operation of various actuators including the compressor 1, the injection circuit expansion valve 21, and the main circuit expansion valve 22 based on detection information received from the high-pressure sensor 14, the low-pressure sensor 15, and the compressor shell temperature sensor 16. The indoor unit control device 19 is programmed to control the operation of various actuators including the indoor expansion valve 10 based on detection information received from the indoor heat exchanger outlet temperature sensor 17. Further, the indoor unit control device 19 communicates to/from the outdoor unit control device 18 to share the detection information of the various sensors.

Figure 2:
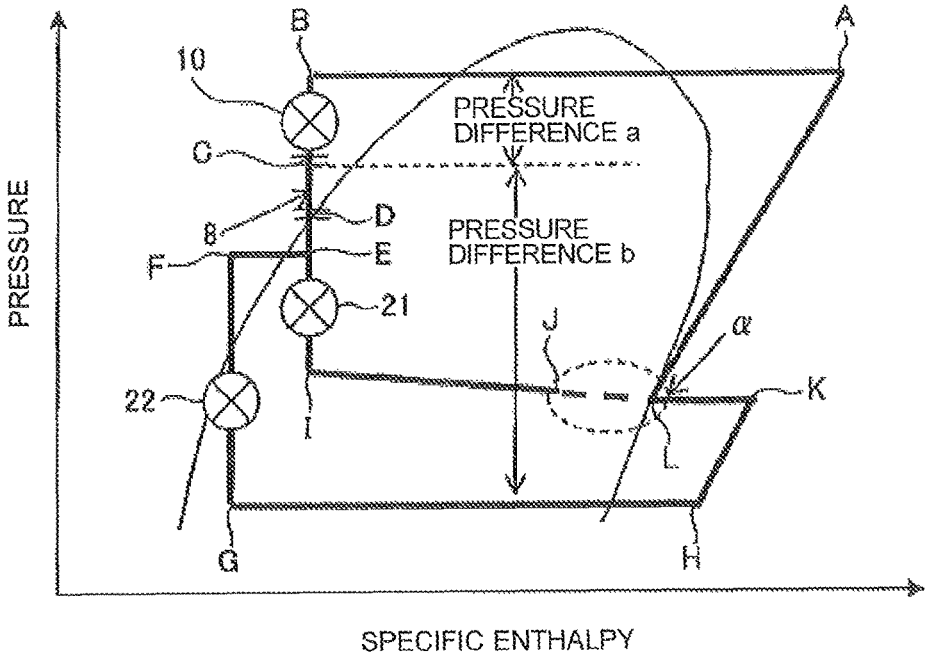
FIG. 2 is a Mollier chart illustrating an example of an operation state during heating operation in the air-conditioning apparatus according to Embodiment 1 of the present invention.

FIG. 2 is a Mollier chart illustrating an example of an operation state during the heating operation in the air-conditioning apparatus according to this embodiment. FIG. 2 illustrates a state of performing injection in which the intermediate-pressure two-phase refrigerant is injected into the compressor 1 through the injection circuit 40. An example of the operational control for the indoor expansion valve 10, the injection circuit expansion valve 21, and the main circuit expansion valve 22 is described later.

The high-temperature and high-pressure gas refrigerant (point A in FIG. 2) compressed by the compressor 1 during the heating operation passes through the four-way valve 2, the gas-side extension pipe 9, and the like to flow into the indoor heat exchanger 11. During the heating operation, the indoor heat exchanger 11 serves as a condenser. That is, in the indoor heat exchanger 11, heat is exchanged between the gas refrigerant flowing inside and air (indoor air) sent by the indoor fan 12 so that the condensation heat of the refrigerant is transferred to the sent air. With this, the refrigerant flowing into the indoor heat exchanger 11 is condensed to become a high-pressure liquid refrigerant (point B in FIG. 2). Further, the air sent by the indoor fan 12 is heated by the heat radiating action of the refrigerant to become hot air. The high-pressure liquid refrigerant condensed by the indoor heat exchanger 11 flows into the indoor expansion valve 10, and is depressurized to become an intermediate-pressure liquid refrigerant (point C in FIG. 2). The intermediate-pressure liquid refrigerant flowing out from the indoor expansion valve 10 passes through the liquid-side extension pipe 8 to be depressurized due to a pressure loss, and flows into the outdoor unit 7 as a liquid refrigerant or a two-phase refrigerant (point D in FIG. 2). Almost the entire refrigerant in the liquid-side extension pipe 8 is in a liquid phase.

The liquid refrigerant or the two-phase refrigerant flowing into the outdoor unit 7 is depressurized due to the pressure loss of the refrigerant pipe in the outdoor unit 7, and reaches the branching portion 31 as the two-phase refrigerant (point E in FIG. 2). At the branching portion 31, a part of the two-phase refrigerant flows separately to the injection circuit 40, and the remaining two-phase refrigerant flows into the internal heat exchanger 20 (in this embodiment, the outer flow passage). The two-phase refrigerant flowing into the outer flow passage of the internal heat exchanger 20 decreases its specific enthalpy through heat exchange with the two-phase refrigerant separately flowing to the injection circuit 40 to decrease the temperature, to thereby become a liquid refrigerant (point F in FIG. 2).

This liquid refrigerant is depressurized by the main circuit expansion valve 22 to become a low-pressure two-phase refrigerant (point G in FIG. 2). The low-pressure two-phase refrigerant flows into the outdoor heat exchanger 3. During the heating operation, the outdoor heat exchanger 3 serves as an evaporator. That is, in the outdoor heat exchanger 3, heat is exchanged between the refrigerant flowing inside and air (outside air) sent by the outdoor fan 4 so that the evaporation heat of the refrigerant receives heat from the sent air. With this, the refrigerant flowing into the outdoor heat exchanger 3 is evaporated to become a low-pressure gas refrigerant (point H in FIG. 2). The low-pressure gas refrigerant passes through the four-way valve 2 to be sucked into the compressor 1, and is compressed by the compressor 1.

On the other hand, the two-phase refrigerant separately flowing into the injection circuit 40 is depressurized by the injection circuit expansion valve 21 to flow into the internal heat exchanger 20 (in this embodiment, the inner flow passage) (point I in FIG. 2). The two-phase refrigerant flowing into the inner flow passage of the internal heat exchanger 20 increases its specific enthalpy through heat exchange with the high-temperature two-phase refrigerant flowing through the outer flow passage, to thereby become a high-quality two-phase refrigerant (point J in FIG. 2).

The two-phase refrigerant is injected through the injection circuit 40 (portion a in FIG. 2) into the compression chamber of the compressor 1 in the middle of the compression process in which the low-pressure gas refrigerant (point H in FIG. 2) is compressed (point K in FIG. 2). With this, the gas refrigerant in the middle of compression and the injected two-phase refrigerant are mixed with each other (point L in FIG. 2). The mixed refrigerant is compressed by the compressor 1 to have high temperature and high pressure (point A in FIG. 2). Those cycles are repeated in the heating operation.

Next, the example of the operational control for various actuators during the heating operation is described. The indoor expansion valve 10 is controlled by the indoor unit control device 19 or the outdoor unit control device 18 to perform the opening and closing operation so that subcool SC [deg] actually secured by the indoor heat exchanger 11 approaches a desired value SCm [deg] set in advance. The subcool SC is determined by subtracting the indoor heat exchanger outlet temperature Tcout from the saturation condensing temperature Ct. The indoor unit control device 19 or the outdoor unit control device 18 controls the opening degree of the indoor expansion valve 10 based on the difference between the subcool SC and the desired value SCm.

The injection circuit expansion valve 21 is controlled by the outdoor unit control device 18 to maintain a fully closed state (opening degree C.=0) in a normal case (when an injection start condition is not satisfied). When the injection start condition is satisfied, the injection circuit expansion valve 21 is controlled by the outdoor unit control device 18 to be in an open state (0<opening degree C.≤1). When the injection circuit expansion valve 21 is in an open state, the injection in which the intermediate-pressure two-phase refrigerant is injected into the compressor 1 through the injection circuit 40 is started. As the injection start condition, there may be given conditions such as a condition that the outside air temperature is lower than a predetermined value set in advance, a condition that the pressure Pd is lower than a predetermined value set in advance, and a condition that an elapsed time from the start of operation of the compressor 1 is equal to or more than a predetermined time set in advance.

The opening degree C. of the injection circuit expansion valve 21 after the injection is started is controlled based on discharge superheat SHd. Specifically, the opening degree C. of the injection circuit expansion valve 21 after the injection is started is feedback controlled so that the discharge superheat SHd becomes $c \leq SHd \leq d$. That is, the opening degree C. of the injection circuit expansion valve 21 is determined independently of an opening degree A of the main circuit expansion valve 22 without using Relation $A+C=B \times Gr$ for the opening degree A to be described later. The discharge superheat SHd is determined by subtracting the saturation condensing temperature Ct from the discharge temperature Td. The values c [deg] and d [deg] are a lower limit value and an upper limit value of the range of the desired discharge superheat SHd set in advance, respectively.

The opening degree of the main circuit expansion valve 22 is controlled so that a decompression amount a [kgf/cm$^2$] at the indoor expansion valve 10 serving as an upstream-side expansion valve in the expansion process during the heating operation and a decompression amount b [kgf/cm$^2$] at the main circuit expansion valve 22 serving as a downstream-side expansion valve are maintained to an expansion ratio of x:y set in advance. More accurately, the decompression amount a is a pressure difference "b"etween the pressure of the refrigerant flowing out from the indoor heat exchanger 11 and the pressure of the refrigerant flowing into the liquid-side extension pipe 8. More accurately, the decompression amount b is a pressure difference "b"etween the pressure of the refrigerant that has passed through the indoor expansion valve 10 and the pressure of the refrigerant flowing into the outdoor heat exchanger 3. The expansion ratio x:y can be arbitrarily set, but as illustrated in FIG. 2, it is desired that the decompression amount a be set relatively small, and the decompression amount b be set relatively large. In this manner, a larger amount of single-phase liquid refrigerant can exist in the liquid-side extension pipe 8. As a result, during the heating operation, a larger amount of surplus refrigerant can be accumulated in the liquid-side extension pipe 8.

Specifically, the opening degree A ($0 \leq$ opening degree $A \leq 1$) of the main circuit expansion valve 22 is derived based on a relational expression of $A+C=B \times Gr$. Note that, C represents an opening degree of the injection circuit expansion valve 21, B [opening degree/(kg/h)] represents a coefficient to be described later, and Gr [kg/h] represents a refrigerant circulating amount. Note that, the opening degree C. is 0 when the injection is not performed, and hence the opening degree A of the main circuit expansion valve 22 is substantially derived based on a relational expression of $A=B \times Gr$.

The decompression amount b after passage of the indoor expansion valve 10 is $b=(Gr/27.1/A)^2/\rho s$ when the injection is not performed, that is, the opening degree C. of the injection circuit expansion valve 21 is 0. Note that, Gr [kg/h] represents a refrigerant circulating amount, A represents an opening degree of the main circuit expansion valve 22, and $\rho s$ [kg/m$^3$] represents a suction gas density in the compressor 1. The injection circuit expansion valve 21 and the main circuit expansion valve 22 are arranged in parallel to each other, and hence when the injection is performed, that is, the opening degree C. of the injection circuit expansion valve 21 is larger than 0, the decompression amount b becomes $b=(Gr/27.1/(A+C))^2/\rho s$. Therefore, the opening degree A of the main circuit expansion valve 22 when the injection is performed can be appropriately derived based on a relational expression obtained by assigning A+C to the left side of Relation $A=B \times Gr$ used when the injection is not performed.

Figure 3:
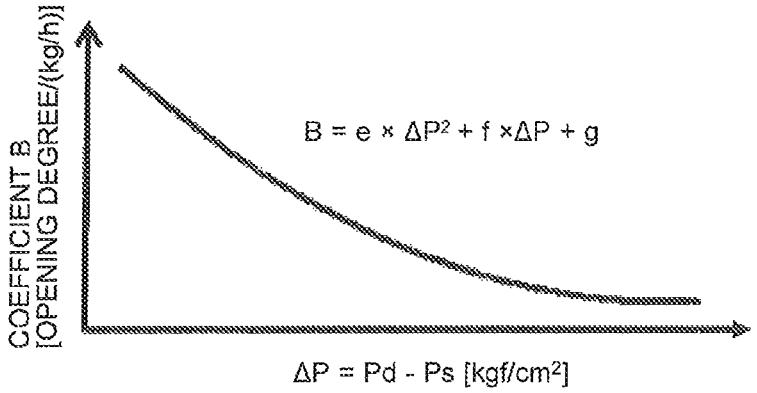
FIG. 3 is a graph showing a relationship between a coefficient B and a pressure difference ΔP according to Embodiment 1 of the present invention.

The coefficient B represents an opening degree of the main circuit expansion valve 22 per unit refrigerant circulating amount necessary for maintaining the expansion ratio x:y. The coefficient B is determined by an experimental expression based on a pressure difference $\Delta P$ between the discharge pressure Pd and the suction pressure Ps. FIG. 3 is a graph showing a relationship between the coefficient B and the pressure difference $\Delta P$ in this embodiment. In the graph, the lateral axis represents the pressure difference $\Delta P$ [kgf/cm$^2$] (=Pd [kgf/cm$^2$G]−Ps [kgf/cm$^2$G]), and the vertical axis represents the coefficient B [opening degree/(kg/h)]. As shown in FIG. 3, the coefficient B is represented by $B=e \times \Delta P^2+f \times \Delta P+g$ being a quadratic expression in the pressure difference $\Delta P$. Note that, values e, f, and g are each a constant.

The refrigerant circulating amount Gr can be derived by $Gr=vst \times fz \times 3600 \times 10^{-6} \times \rho s \times \eta v$ with use of a stroke volume vst [cc] of the compressor 1, an operation frequency fz [rps] of the compressor 1, a suction gas density $\rho s$ [kg/m$^3$] of the compressor 1, and a volumetric efficiency $\eta v$ (dimensionless number) of the compressor 1. An approximate value of the suction gas density $\rho s$ can be determined based on the suction pressure Ps.

Figure 4:
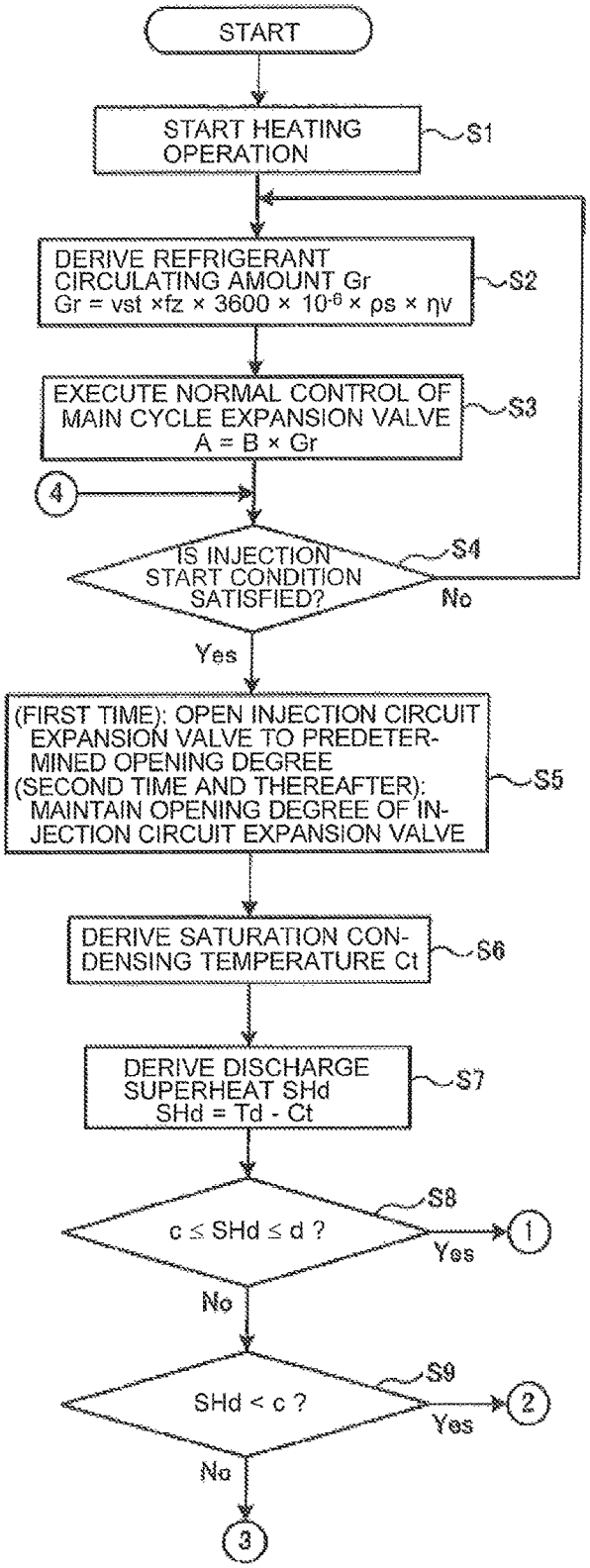
FIG. 4 is a flow chart illustrating an example of heating operation processing to be executed by an outdoor unit control device 18 of the air-conditioning apparatus according to Embodiment 1 of the present invention.
Figure 5:
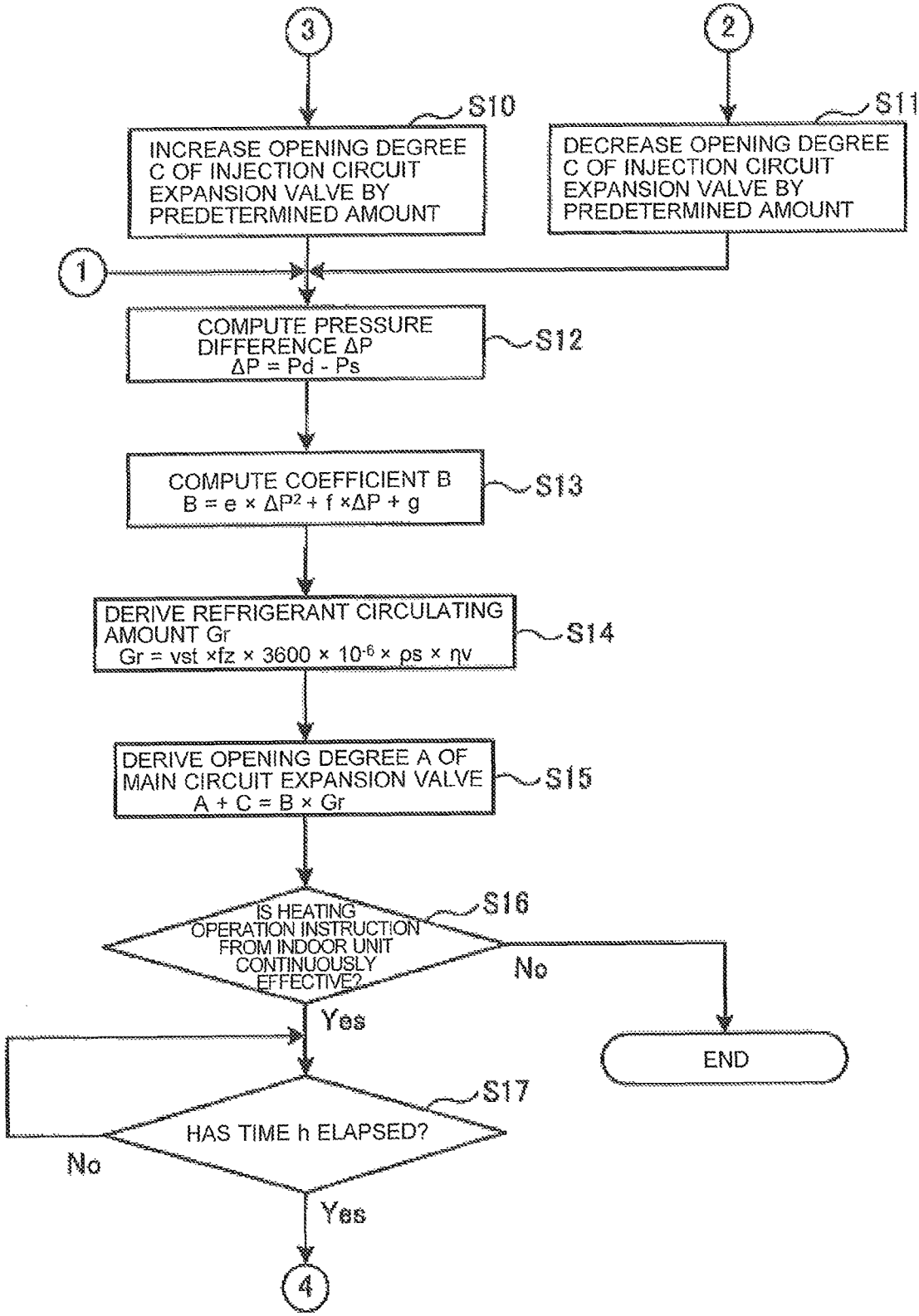
FIG. 5 is a flow chart illustrating the example of the heating operation processing to be executed by the outdoor unit control device 18 of the air-conditioning apparatus according to Embodiment 1 of the present invention.

FIG. 4 and FIG. 5 are flow charts illustrating an example of heating operation processing to be executed by the outdoor unit control device 18. The heating operation processing is started when a heating operation instruction from the indoor unit 13 (for example, the indoor unit control device 19) is received. Note that, in the initial state, the opening degree C. of the injection circuit expansion valve 21 is 0 (closed state).

First, in Step S1, the heating operation is started. For example, the outdoor unit control device 18 performs control so as to switch the flow passage of the four-way valve 2 so that the high-temperature and high-pressure refrigerant is supplied to the indoor heat exchanger 11. Further, the outdoor unit control device 18 resets the timer to start measuring the time.

Next, based on Relation $Gr=vst \times fz \times 3600 \times 10^{-6} \times \rho s \times \eta v$, the refrigerant circulating amount Gr of the refrigeration cycle 30 is derived (Step S2).

Next, based on Relation $A=B \times Gr$, the opening degree A of the main circuit expansion valve 22 is derived, to thereby execute normal control of setting the opening degree of the main circuit expansion valve 22 to the opening degree A (Step S3). Note that, in Step S3, the opening degree A may be derived based on Relation $A+C=B \times Gr$. At the time point of Step S3, the opening degree C. of the injection circuit expansion valve 21 is 0, and hence the same opening degree A is derived based on any of Relation $A=B \times Gr$ and Relation $A+C=B \times Gr$.

Next, it is determined whether or not the above-mentioned injection start condition is satisfied (Step S4). When it is determined that the injection start condition is satisfied, the processing proceeds to Step S5, and when it is determined that the injection start condition is not satisfied, the processing returns to Step S2.

In the processing of Step S5 at the first time (the first processing after the heating operation processing is started), control of opening the injection circuit expansion valve 21 to a predetermined opening degree set in advance is performed. In the processing of Step S5 at the second time and thereafter, the opening degree of the injection circuit expansion valve 21 is maintained as it is.

Next, based on the discharge pressure Pd, the saturation condensing temperature Ct is derived (Step S6).

Next, based on Relation $SHd=Td-Ct$, the discharge superheat SHd is derived (Step S7).

Next, it is determined whether or not the discharge superheat SHd satisfies the relationship of $c \leq SHd \leq d$ (Step S8). When it is determined that the discharge superheat SHd satisfies the relationship of $c \leq SHd \leq d$, the processing proceeds to Step S12, and when it is determined that the discharge superheat SHd does not satisfy the relationship of $c \leq SHd \leq d$, the processing proceeds to Step S9.

In Step S9, it is determined whether or not the discharge superheat SHd satisfies the relationship of $SHd<c$. When it is determined that the discharge superheat SHd satisfies the relationship of $SHd<c$, the processing proceeds to Step S11, and when it is determined that the discharge superheat SHd does not satisfy the relationship of $SHd<c$ (that is, when $SHd>d$ is satisfied), the processing proceeds to Step S10.

In Step S10, processing of increasing the opening degree C. of the injection circuit expansion valve 21 by a predetermined amount is performed. That is, in the case of $SHd>d$, the opening degree C. of the injection circuit expansion valve 21 is increased by a predetermined amount. Information of the opening degree C. after the increase is stored in a storage area of the RAM. After that, the processing proceeds to Step S12.

In Step S11, processing of decreasing the opening degree C. of the injection circuit expansion valve 21 by a predetermined amount is performed. That is, in the case of $SHd<c$, the opening degree C. of the injection circuit expansion valve 21 is decreased by a predetermined amount. Information of the opening degree C. after the decrease is stored in the storage area of the RAM. After that, the processing proceeds to Step S12.

In Step S12, based on Relation $\Delta P=Pd-Ps$, the pressure difference $\Delta P$ is calculated.

Next, based on Relation $B=e\times\Delta P^2+f\times\Delta P+g$, the coefficient B is calculated (Step S13).

Next, based on Relation $Gr=vst\times fz\times 3600\times 10^{-6}\times\rho s\times\eta v$, the refrigerant circulating amount Gr of the refrigeration cycle 30 is derived again (Step S14).

Next, based on Relation $A+C=B\times Gr$, the opening degree A of the main circuit expansion valve 22 is derived again, and control of setting the opening degree of the main circuit expansion valve 22 to the new opening degree A is performed (Step S15).

Next, it is determined whether or not the heating operation instruction from the indoor unit 13 (for example, the indoor unit control device 19) is continuously issued (Step S16). When it is determined that the heating operation instruction is continuously issued, the processing proceeds to Step S17, and when it is determined that the heating operation instruction is not continuously issued, the heating operation processing is ended.

In Step S17, it is determined whether or not the time elapsed from the reset of the timer exceeds a time h set in advance. When it is determined that the elapsed time exceeds the time h, the timer is reset, and the processing returns to Step S4. When it is determined that the elapsed time does not exceed the time h, the apparatus waits until the elapsed time exceeds the time h.

Figure 6:
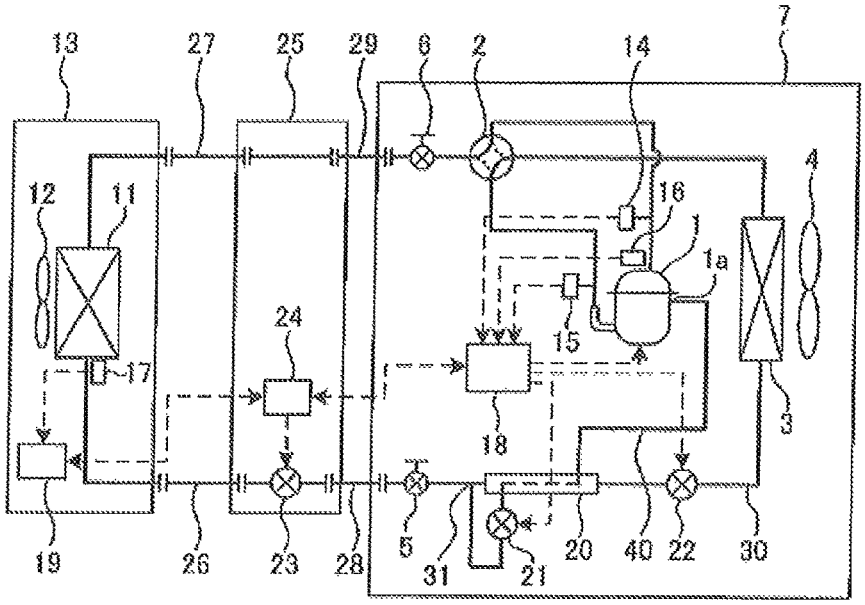
FIG. 6 is a refrigerant circuit diagram illustrating a schematic configuration of an air-conditioning apparatus according to a first modified example of Embodiment 1 of the present invention.

FIG. 6 is a refrigerant circuit diagram illustrating a schematic configuration of an air-conditioning apparatus according to a first modified example of this embodiment. As illustrated in FIG. 6, in this modified example, unlike the configuration illustrated in FIG. 1, the indoor unit 13 does not include the indoor expansion valve 10. In this modified example, an expansion valve storage kit 25 (example of a pressure reducing device accommodation unit) is provided separately from the outdoor unit 7 and the indoor unit 13, and an expansion valve 23 accommodated in the expansion valve storage kit 25 is used instead of the indoor expansion valve 10.

Further, the expansion valve storage kit 25 includes a controller 24 for controlling the expansion valve 23. The controller 24 includes a microcomputer including a CPU, a ROM, a RAM, a timer, and an I/O port. The controller 24 communicates to/from the indoor unit control device 19 and the outdoor unit control device 18 to share the detection information of the various sensors. The expansion valve 23 is controlled by the controller 24 to perform the opening and closing operation so that the subcool SC actually secured by the indoor heat exchanger 11 approaches the desired value SCm.

The expansion valve storage kit 25 and the indoor unit 13 are connected to each other through a liquid-side extension pipe 26 and a gas-side extension pipe 27 that are a part of the refrigerant pipes of the refrigeration cycle 30. Further, the expansion valve storage kit 25 and the outdoor unit 7 are connected to each other through a liquid-side extension pipe 28 and a gas-side extension pipe 29 that are a part of the refrigerant pipes of the refrigeration cycle 30.

Figure 7:
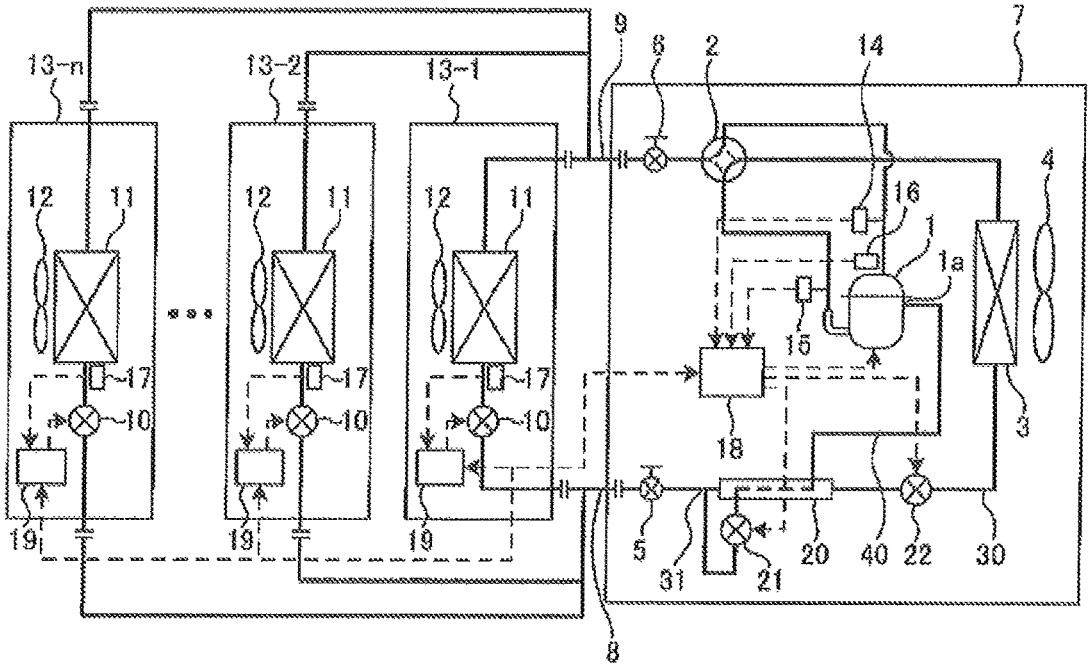
FIG. 7 is a refrigerant circuit diagram illustrating a schematic configuration of an air-conditioning apparatus according to a second modified example of Embodiment 1 of the present invention.

FIG. 7 is a refrigerant circuit diagram illustrating a schematic configuration of an air-conditioning apparatus according to a second modified example of this embodiment. As illustrated in FIG. 7, in this modified example, a multi-air-conditioning apparatus including a plurality of indoor units 13-1, 13-2, . . . , and 13-*n* is exemplified. Each of the indoor units 13-1, 13-2, . . . , and 13-*n* has a configuration similar to that of the indoor unit 13 illustrated in FIG. 1. The indoor heat exchangers 11 and the indoor expansion valves 10 arranged in the respective indoor units 13-1, 13-2, . . . , and 13-*n* are connected in parallel to each other in the refrigeration cycle 30. Also in this modified example, various actuators are controlled similarly to the configuration illustrated in FIG. 1.

Figure 8:
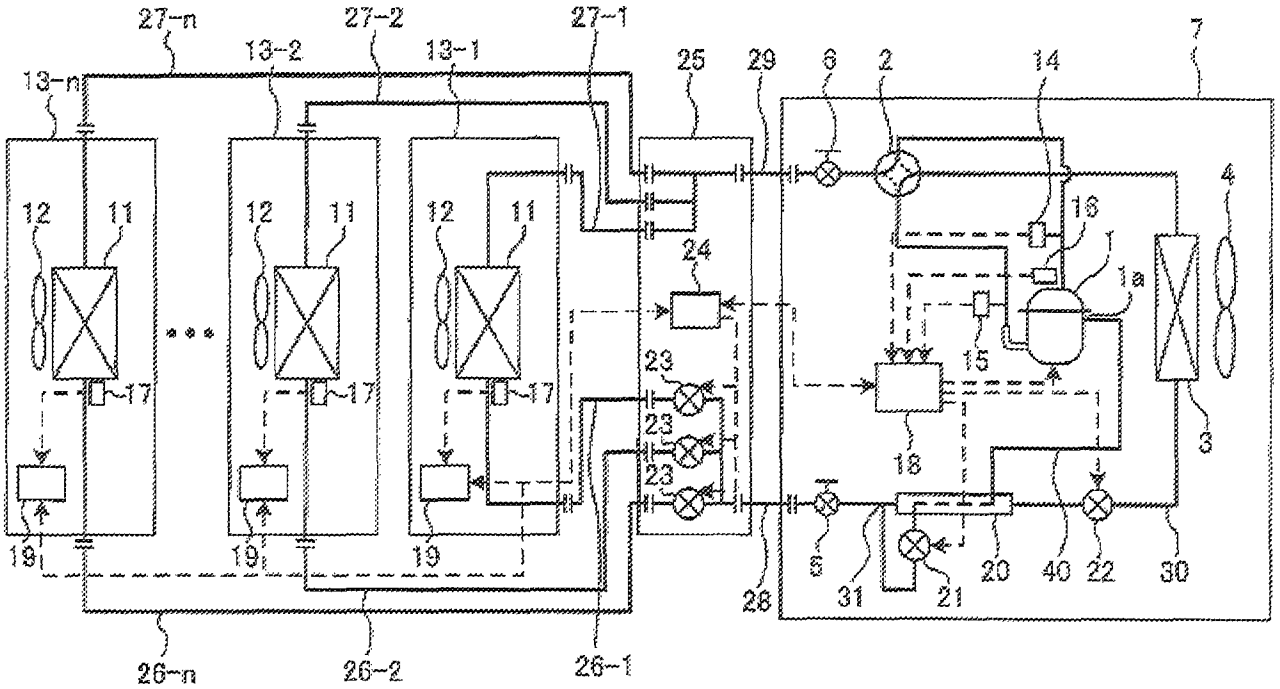
FIG. 8 is a refrigerant circuit diagram illustrating a schematic configuration of an air-conditioning apparatus according to a third modified example of Embodiment 1 of the present invention.

FIG. 8 is a refrigerant circuit diagram illustrating a schematic configuration of an air-conditioning apparatus according to a third modified example of this embodiment. As illustrated in FIG. 8, in this modified example, a multi-air-conditioning apparatus including a plurality of indoor units 13-1, 13-2, . . . , and 13-*n* is exemplified. Each of the indoor units 13-1, 13-2, . . . , and 13-*n* has a configuration similar to that of the indoor unit 13 illustrated in FIG. 6. The indoor heat exchangers 11 arranged in the respective indoor units 13-1, 13-2, . . . , and 13-*n* are connected in parallel to each other in the refrigeration cycle 30.

Further, the expansion valve storage kit 25 has the plurality of expansion valves 23 corresponding to the respective indoor units 13-1, 13-2, . . . , and 13-*n* accommodated therein. The plurality of expansion valves 23 are controlled by the controller 24 to each perform the opening and closing operation so that the subcool SC actually secured by the corresponding indoor heat exchanger 11 approaches the desired value SCm.

The expansion valve storage kit 25 and the respective indoor units 13-1, 13-2, . . . , and 13-*n* are connected to each other through liquid-side extension pipes 26-1, 26-2, . . . , and 26-*n* and gas-side extension pipes 27-1, 27-2, . . . , and 27-*n*. Further, the expansion valve storage kit 25 and the outdoor unit 7 are connected to each other through the liquid-side extension pipe 28 and the gas-side extension pipe 29. Also in this modified example, various actuators are controlled similarly to the configuration illustrated in FIG. 1.

As described above, the air-conditioning apparatus according to the present invention includes: the refrigeration cycle 30 in which the compressor 1 having the injection port 1*a*, the indoor heat exchanger 11, the indoor expansion valve 10 (or the expansion valve 23), the main circuit expansion valve 22, and the outdoor heat exchanger 3 are annularly connected to each other; the injection circuit 40 for connecting between the injection port 1*a* and the branching portion 31 arranged between the indoor expansion valve 10 and the main circuit expansion valve 22 of the refrigeration cycle 30; the injection circuit expansion valve 21 arranged in the injection circuit 40; the internal heat exchanger 20 for exchanging heat between the refrigerant flowing between the branching portion 31 and the main circuit expansion valve 22 and the refrigerant depressurized by the injection circuit expansion valve 21; and the outdoor unit control device 18 for controlling at least the opening degree A of the main circuit expansion valve 22. The refrigeration cycle 30 can perform the heating operation in which the indoor heat exchanger 11 serves as a condenser and the outdoor heat exchanger 3 serves as an evaporator. The outdoor unit control device 18 is configured to control the opening degree A of the main circuit expansion valve 22 so as to satisfy Relation A+C=B×Gr, where A represents the opening degree of the main circuit expansion valve 22, C represents the opening degree of the injection circuit expansion valve 21, B represents the coefficient determined based on the discharge pressure and the suction pressure of the compressor 1, and Gr represents the refrigerant circulating amount in the refrigeration cycle 30.

With this configuration, when the injection is performed during the heating operation, the opening degree A of the main circuit expansion valve 22 can be appropriately controlled, and the ratio of the liquid refrigerant in a region between the indoor expansion valve 10 and the branching portion 31 (for example, in the liquid-side extension pipe 8) can be increased. Therefore, during the heating operation, a larger amount of refrigerant can be accumulated in the refrigerant pipe. Therefore, the difference between the amount of refrigerant necessary during cooling operation and the amount of refrigerant necessary during heating operation can be absorbed. With this, it is possible to prevent the liquid-back phenomenon to the compressor 1 due to the surplus refrigerant during the heating operation, and hence the reliability and durability of the compressor 1 can be improved.

Further, with this configuration, it is unnecessary to add a pressure sensor for detecting a pressure (intermediate pressure) of the refrigerant between the indoor expansion valve 10 and the branching portion 31, and hence the manufacturing cost of the air-conditioning apparatus can be kept low.

In particular, in the multi-air-conditioning apparatus including the plurality of indoor units 13, the length of the liquid-side extension pipes 8 and 28 is large in many cases, and hence the difference between the amount of refrigerant necessary during cooling operation and the amount of refrigerant necessary during heating operation tends to increase. Therefore, a higher effect can be obtained by applying this embodiment to the multi-air-conditioning apparatus as in the configuration illustrated in FIG. 7 and FIG. 8.

Further, according to this embodiment, a larger amount of surplus refrigerant can be accumulated in the refrigerant pipe during the heating operation, and hence the volume of a low pressure-side liquid reservoir (accumulator) can be reduced, and the usage amount of the forming material for the accumulator (for example, iron) can be reduced.

Other Embodiment

The present invention is not limited to the above-mentioned embodiment, and various modifications may be made thereto.

In the above-mentioned embodiment, the outdoor unit 7 and the indoor unit 13 are connected to each other through two extension pipes (liquid-side extension pipe 8 and gas-side extension pipe 9), but the outdoor unit 7 and the indoor unit 13 may be connected to each other through three extension pipes or more.

Further, the embodiment and the modified examples described above may be implemented in combination.

REFERENCE SIGNS LIST

1 compressor 1*a* injection port 2 four-way valve 3 outdoor heat exchanger 4 outdoor fan 5 liquid-side extension pipe connecting valve 6 gas-side extension pipe connecting valve 7 outdoor unit 8, 26, 26-1, 26-2, 26-*n*, 28, 102 liquid-side extension pipe 9, 27, 27-1, 27-2, 27-*n*, 29 gas-side extension pipe 10, 101 indoor expansion valve 11 indoor heat exchanger 12 indoor fan 13, 13-1, 13-2, 13-*n* indoor unit 14 high-pressure sensor 15 low-pressure sensor 16 compressor shell temperature sensor 17 indoor heat exchanger outlet temperature sensor 18 outdoor unit control device 19 indoor unit control device 20 internal heat exchanger 21, 104 injection circuit expansion valve 22, 103 main circuit expansion valve 23 expansion valve 24 controller 25 expansion valve storage kit 30 refrigeration cycle 31 branching portion 40 injection circuit

The invention claimed is:

1. An air-conditioning apparatus, comprising:

a refrigeration cycle connecting, by refrigerant pipes, a compressor having an injection port, an indoor heat exchanger, a first pressure reducing device, a second pressure reducing device, and an outdoor heat exchanger;

an injection circuit connecting between the injection port and a branching portion arranged between the first pressure reducing device and the second pressure reducing device of the refrigeration cycle;

a third pressure reducing device arranged in the injection circuit;

an internal heat exchanger configured to exchange heat between refrigerant flowing between the branching portion and the second pressure reducing device and refrigerant depressurized by the third pressure reducing device; and a controller programmed to control at least an opening degree of the second pressure reducing device, the refrigeration cycle being operable in a heating operation in which the indoor heat exchanger serves as a condensor and the outdoor heat exchanger serves as an evaporator, wherein the controller is programmed to control an opening degree (A) of the second pressure reducing device to satisfy Relation A+C=B×Gr, where A represents the opening degree of the second pressure reducing device, C represents an opening degree of the third pressure reducing device, B represents a coefficient determined based on a discharge pressure and a suction pressure of the compressor, and Gr represents a refrigerant circulating amount in the refrigeration cycle.

2. The air-conditioning apparatus of claim 1, wherein the controller is programmed to control the opening degree (C.) of the third pressure reducing device based on discharge superheat of the compressor.

3. The air-conditioning apparatus of claim 1, further comprising:

an outdoor unit accommodating at least the outdoor heat exchanger; and an indoor unit accommodating at least the indoor heat exchanger and the first pressure reducing device.

4. The air-conditioning apparatus of claim 1, further comprising:

an outdoor unit accommodating at least the outdoor heat exchanger;

an indoor unit accommodating at least the indoor heat exchanger; and a pressure reducing device accommodation unit arranged separately from the outdoor unit and the indoor unit, the pressure reducing device accommodation unit accommodating at least the first pressure reducing device.

5. The air-conditioning apparatus of claim 3, wherein the indoor unit is one of a plurality of indoor units.

6. The air-conditioning apparatus of claim 4, wherein the indoor unit is one of a plurality of indoor units.

7. An air-conditioning apparatus, comprising:

a refrigeration cycle connecting, by refrigerant pipes, a compressor having an injection port, an indoor heat exchanger, a first pressure reducing device, a second pressure reducing device, and an outdoor heat exchanger;

an injection circuit connecting between the injection port and a branching portion arranged between the first pressure reducing device and the second pressure reducing device of the refrigeration cycle;

a third pressure reducing device arranged in the injection circuit;

an internal heat exchanger configured to exchange heat between refrigerant flowing between the branching portion and the second pressure reducing device and refrigerant depressurized by the third pressure reducing device; and control means for controlling at least an opening degree of the second pressure reducing device, the refrigeration cycle being operable in a heating operation in which the indoor heat exchanger serves as a condensor and the outdoor heat exchanger serves as an evaporator, wherein the control means controls an opening degree (A) of the second pressure reducing device to satisfy Relation $A+C=B\times Gr$, where A represents the opening degree of the second pressure reducing device, C represents an opening degree of the third pressure reducing device, B represents a coefficient determined based on a discharge pressure and a suction pressure of the compressor, and Gr represents a refrigerant circulating amount in the refrigeration cycle.

8. The air-conditioning apparatus of claim 7, wherein the control means controls the opening degree (C.) of the third pressure reducing device based on discharge superheat of the compressor.

9. The air-conditioning apparatus of claim 7, further comprising:

an outdoor unit accommodating at least the outdoor heat exchanger; and an indoor unit accommodating at least the indoor heat exchanger and the first pressure reducing device.

10. The air-conditioning apparatus of claim 7, further comprising:

an outdoor unit accommodating at least the outdoor heat exchanger;

an indoor unit accommodating at least the indoor heat exchanger; and a pressure reducing device accommodation unit arranged separately from the outdoor unit and the indoor unit, the pressure reducing device accommodation unit accommodating at least the first pressure reducing device.

11. The air-conditioning apparatus of claim 9, wherein the indoor unit is one of a plurality of indoor units.

12. The air-conditioning apparatus of claim 10, wherein the indoor unit is one of a plurality of indoor units.

13. An air-conditioning apparatus, comprising:

a refrigeration cycle connecting, by refrigerant pipes, a compressor having an injection port, an indoor heat exchanger, a first pressure reducing device, a second pressure reducing device, and an outdoor heat exchanger;

an injection circuit connecting between the injection port and a branching portion arranged between the first pressure reducing device and the second pressure reducing device of the refrigeration cycle;

a third pressure reducing device arranged in the injection circuit;

an internal heat exchanger configured to exchange heat between refrigerant flowing between the branching portion and the second pressure reducing device and refrigerant depressurized by the third pressure reducing device; and a controller configured to control at least an opening degree of the second pressure reducing device, the refrigeration cycle being operable in a heating operation in which the indoor heat exchanger serves as a condensor and the outdoor heat exchanger serves as an evaporator, wherein the controller is configured to control an opening degree (A) of the second pressure reducing device to satisfy Relation $A+C=B\times Gr$, where A represents the opening degree of the second pressure reducing device, C represents an opening degree of the third pressure reducing device, B represents a coefficient determined based on a discharge pressure and a suction pressure of the compressor, and Gr represents a refrigerant circulating amount in the refrigeration cycle.

14. The air-conditioning apparatus of claim 13, wherein the controller is configured to control the opening degree (C.) of the third pressure reducing device based on discharge superheat of the compressor.

15. The air-conditioning apparatus of claim 13, further comprising:

an outdoor unit accommodating at least the outdoor heat exchanger; and an indoor unit accommodating at least the indoor heat exchanger and the first pressure reducing device.

16. The air-conditioning apparatus of claim 13, further comprising:

an outdoor unit accommodating at least the outdoor heat exchanger;

an indoor unit accommodating at least the indoor heat exchanger; and a pressure reducing device accommodation unit arranged separately from the outdoor unit and the indoor unit, the pressure reducing device accommodation unit accommodating at least the first pressure reducing device.

17. The air-conditioning apparatus of claim 15, wherein the indoor unit is one of a plurality of indoor units.

18. The air-conditioning apparatus of claim 16, wherein the indoor unit is one of a plurality of indoor units.

* * * * *